United States Patent [19]

Runkle

[11] Patent Number: 4,484,866

[45] Date of Patent: Nov. 27, 1984

[54] PISTON PUMP

[75] Inventor: Dean E. Runkle, LaPorte, Ind.

[73] Assignee: The Bendix Corporation, Southfield, Mich.

[21] Appl. No.: 500,516

[22] Filed: Jun. 2, 1983

[51] Int. Cl.[3] ..... F04B 7/04

[52] U.S. Cl. ..... 417/495; 417/498; 417/501

[58] Field of Search ..... 417/493, 494, 495, 498, 417/501, 490; 123/495, 503

[56] References Cited

U.S. PATENT DOCUMENTS

| | | | |
|---|---|---|---|
| 839,331 | 12/1906 | Stevens | 417/495 |
| 2,410,517 | 11/1946 | Müller | 417/494 |
| 3,473,473 | 10/1969 | Fulmer | 417/295 |
| 3,567,346 | 3/1971 | Mekkes | 417/494 |
| 3,578,881 | 5/1971 | Mowbray | 417/495 |

*Primary Examiner*—Leonard E. Smith
*Assistant Examiner*—Jane E. Obee
*Attorney, Agent, or Firm*—Paul David Schoenle; Ken C. Decker

[57] ABSTRACT

A piston pump includes a cylinder with a bore receiving the piston. The piston forms a central passage leading to a variable volume chamber and a check valve is disposed in the central passage. In addition, the cylinder includes a pair of ports which selectively communicate with the variable volume chamber. The pair of ports and the central passage communicate a reservoir with the variable volume chamber.

7 Claims, 4 Drawing Figures

PISTON PUMP

This invention relates to a piston pump wherein a piston is movable within a housing to generate fluid pressure within a variable volume chamber.

A piston pump is disclosed in U.S. Pat. No. 3,473,473, issued to K. H. Fulmer and owned by the common assignee of this invention. The piston pump includes a housing with a reservoir therein. A cylinder is disposed within the housing to receive a piston within a cylinder bore. The piston cooperates with the cylinder and a check valve at one end of the cylinder to define a variable volume chamber that is pressurized during movement of the piston toward the check valve. The pressurized fluid opens the check valve to communicate fluid pressure to an accummulator. It is possible to control movement of the piston in response to the fluid pressure level in the accummulator by means of an electric motor coupled to a crank and a pressure sensitive switch.

The fluid used for the piston pump includes minute air pockets therein so that during expansion of the variable volume chamber, it is believed that the air pockets are also enlarged or expanded and during contraction of the variable volume chamber the enlarged or expanded air pockets are suddenly contracted. The sudden pressure change for the air pockets is believed to create undesireable noise for the piston pump. Consequently, it is desireable to control the pressure differential between contraction and expansion in the variable volume chamber while at the same time providing sufficient contraction to generate fluid pressure in the variable volume chamber.

The present invention includes a piston pump comprising a housing with an opening therein in communication with a reservoir, a cylinder fixedly disposed within the opening and including a bore, a piston member extending into the cylinder bore and cooperating with the housing and cylinder to substantially define a variable volume chamber selectively communicating with the reservoir in response to movement of the piston member, the variable volume chamber communicating with an accummulator via a first check valve means whereby fluid pressure generated in the variable volume chamber is communicated to the accummulator via the first check valve means, characterized in that said piston member includes a central passage therein communicating the reservoir with the variable volume chamber via a second check valve means disposed in said central passage, said piston member including at least one aperture leading to said central passage, said cylinder defining a first port and a second port extending from the opening to the bore to communicate the reservoir with the latter, said piston member is movable within the cylinder bore from a rest position to an extended position, said piston aperture communicating with said first port in the rest position and remaining in communication therewith during an initial stage of movement for said piston member, said piston aperture communicating with said second port before said piston member reaches the extended position whereby the variable volume chamber is closed to the reservoir only during an intermediate stage of movement for said piston member after the initial stage and before said piston member reaches the extended position.

It is an advantage of the present invention that the variable volume chamber is substantially prevented from decreases in fluid pressure below the fluid pressure level of the reservoir.

One embodiment of the invention is shown in the attached drawings.

Figure 1:
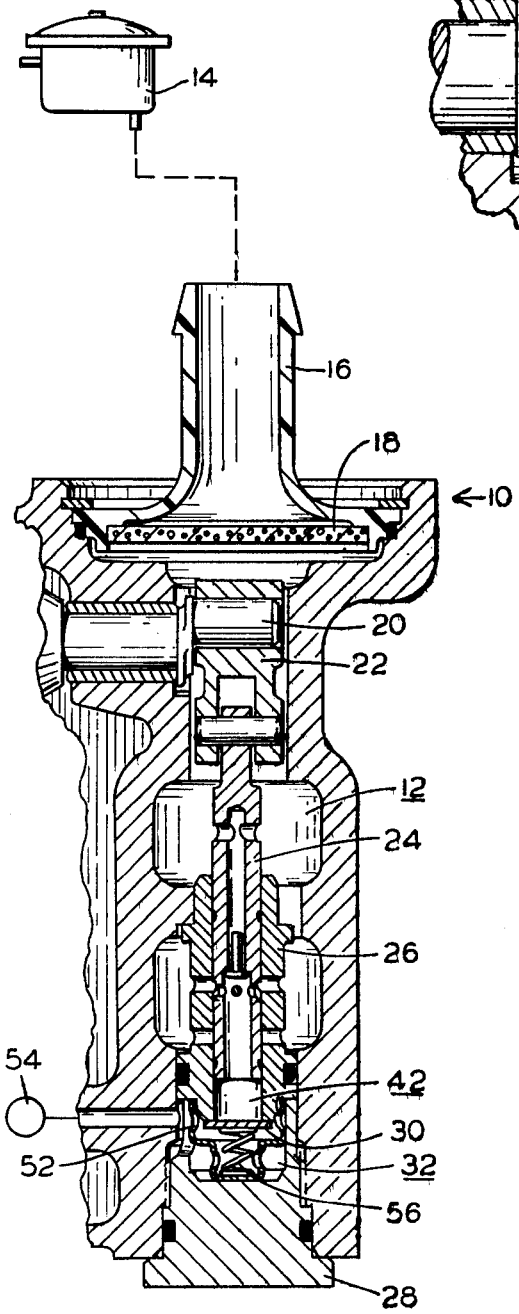
FIG. 1 is a partial view of a pump assembly.

A housing 10 forms an opening 12 therethrough communicating with a reservoir 14 via a fitting 16 fitted with a filter 18. An electric motor (not shown) includes a crank 20 extending into the opening 12 near the filter 18. A connecting link 22 couples the crank 20 with a piston 24 which is movably disposed in a cylinder 26 with a bore 27 therethrough. The cylinder 26 is fixedly disposed in the opening 12 to oppose a plug 28. A check valve 30 is biased into engagement with the end of the cylinder to seal an accummulator 32 relative thereto.

Figure 2:
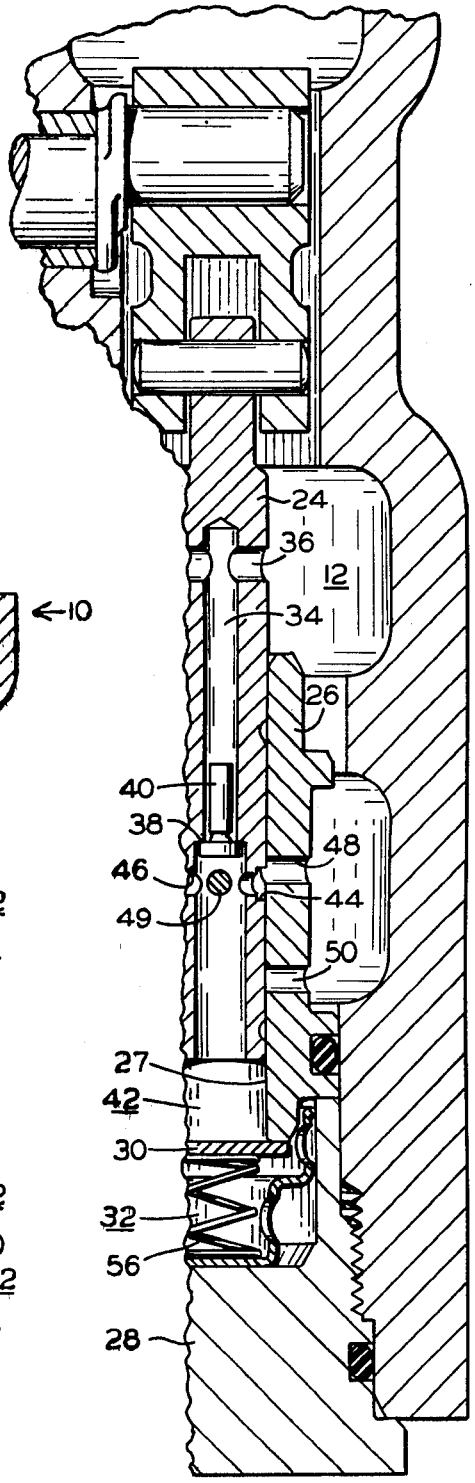
FIG. 2 is an enlarged view similar to FIG. 1 showing the piston at its rest position.

Turning to the enlarged view of FIG. 2, the piston 24 forms a central passage 34 extending from a radial opening 36 to the end of the piston facing the check valve 30. The central passage is stepped to define a shoulder 38 and a one way check valve 40 opposes the shoulder to separate the reservoir 14 via opening 12 from a variable volume chamber 42 formed by the central passage 34, the cylinder 26 and the check valve 30. The piston 24 forms an annular recess 44 intersecting a plurality of apertures 46. A roll pin 49 fitted in two of the apertures 46 opposes the check valve 40 to retain the latter in the central passage near the shoulder 38. The cylinder 26 forms a pair of ports 48 and 50 extending from the reservoir 14 to the bore 27. The plug 28 forms an opening 52 to communicate the accummulator with a suitable fluid pressure storage device 54. A spring 56 biases the check valve 30 to a closed position relative to the end of the cylinder 26.

Figure 3:
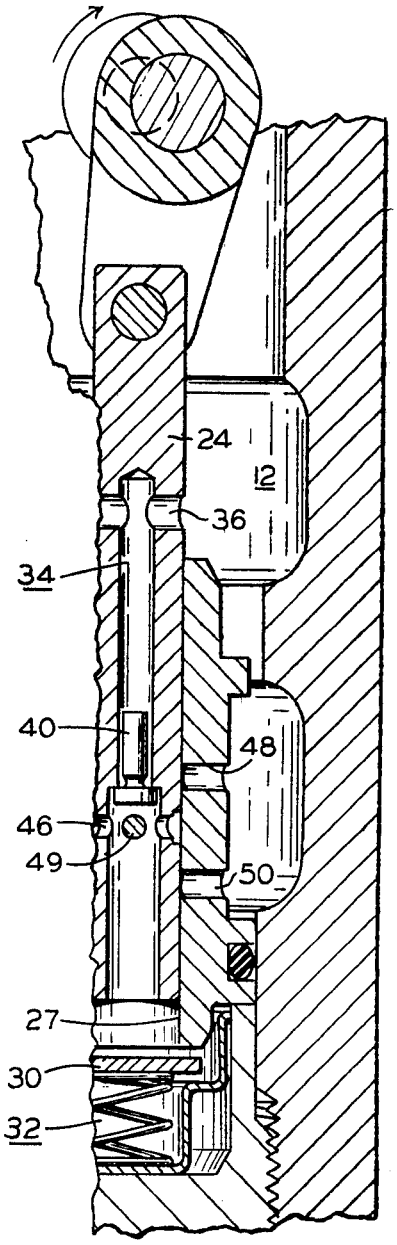
FIG. 3 shows the pump of FIG. 1 in an intermediate position.
Figure 4:
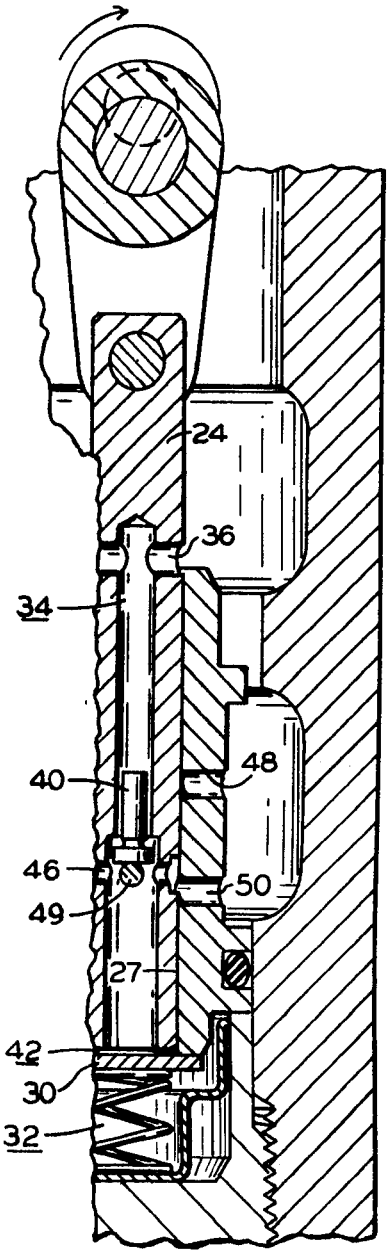
FIG. 4 shows the pump of FIG. 1 in an extended position.

In the rest position of FIG. 2, the piston 24 disposes the aperture 46 partially in alignment with the port 48 so that the variable volume chamber 42 is in communication with the reservoir 14 via passage 34 (above check valve 40) aperture 46, port 48 and opening 12. As the piston is moved initially toward the check valve 30, the volume of chamber 42 is contracted and fluid therein is slightly pressurized to vent a portion of the same to the reservoir 14 via the closing aperture 46. As soon as the aperture 46 passes the port 48, the fluid in chamber 42 is trapped and further piston movement generates fluid pressure therein. In FIG. 3, the aperture 46 is closed to both ports 48 and 50 so that fluid pressure is generated during an intermediate stage. During this intermediate stage, the fluid pressure generated in chamber 42 biases the check valve 30 to open against the force of return spring 31 to communicate fluid pressure to the accummulator 32 and 54. Before the piston reaches its extended position as shown in FIG. 4, the piston 24 disposes the aperture 46 in communication with the port 50 so that before the extended position, the fluid pressure level within chamber 42 is reduced to close check valve 30 and open chamber 42 to reservoir 14. When the extended position is reached, the fluid pressure level within chamber 42 is substantially equal to the fluid pressure level within the reservoir. As the piston 24 initially moves away from the extended position in FIG. 4, the volume of chamber 42 is expanded to initially draw fluid from the port 50 and also to open check valve 40. The aperture 46 is moved out of alignment with port 50 during return from the extended position to the rest position; however, the check valve 40 remains open so that the chamber 42 remains in communication with the reservoir during the entire return stroke from the extended position to the rest position. Thereafter, the cycle is repeated until the fluid pressure communicated to the accummulator reaches a predetermined level so that the motor associated with the crank is turned off.

As shown in FIGS. 2 and 4, the central passage 34 above the check 40 remains open to the reservoir 12 via opening 36 at all times. Consequently, the central passage 34 always extends axially outwardly of the cylinder regardless of the position of the piston 24 in cylinder 26.

In view of the foregoing, a simple piston pump is provided which substantially eliminates a negative pressure for the fluid in the variable volume chamber. Moreover, as the piston reaches its extreme positions, the variable volume chamber is bled to the reservoir via the cylinder ports so that sudden changes in fluid pressure do not accompany changes in direction for the piston.

I claim:

1. A piston pump comprising a housing with an opening therein in communication with a reservoir, a cylinder fixedly disposed within the opening and including a bore, a piston member extending into the cylinder bore and cooperating with the housing and cylinder to substantially define a variable volume chamber selectively communicating with the reservoir in response to movement of the piston member, the variable volume chamber communicating with an accummulator via a first check valve means whereby fluid pressure generated in the variable volume chamber is communicated to the accummulator via the first check valve means, characterized in that said piston member includes a central passage therein communicating the reservoir with the variable volume chamber via a second check valve means disposed in said central passage, said piston member including at least one aperture leading to said central passage, said cylinder defining a first port and a second port extending from the opening to the bore to communicate the reservoir with the latter, said piston member is movable within the cylinder bore from a rest position to an extended position, said piston aperture communicating with said first port in the rest position and remaining in communication therewith during an initial stage of movement for said piston member, said piston aperture communicating with said second port before said piston member reaches the extended position whereby the variable volume chamber is closed to the reservoir only during an intermediate stage of movement for said piston member after the initial stage and before said piston member reaches the extended position.

2. The piston pump of claim 1 in which the intermediate stage comprises less than one half the travel of said piston member between the rest and extended positions.

3. The piston pump of claim 1 in which said second port gradually vents the fluid pressure generated during the intermediate stage so that said second check valve means is opened when said piston member is moving toward the rest position and before said piston member aperture communicates with said first port.

4. The piston pump of claim 1 in which said piston member is provided with a plurality of axially aligned apertures, two of said axially aligned apertures receiving a stop opposing said second check valve means and the remaining apertures extending from the cylinder to the piston member central passage.

5. The pistom pump of claim 1 in which said central passage extends axially outwardly of said cylinder regardless of the position of said piston member within said cylinder.

6. The piston pump of claim 1 in which the fluid pressure generated in the variable volume chamber reaches a maximum level prior to said piston member reaching the extended position and the fluid pressure level at the extended position is substantially the same as the fluid pressure level in the reservoir.

7. A piston pump wherein a piston member oscillates within a housing to generate fluid pressure in a variable volume chamber, said pump comprising, in combination, a cylinder fixedly disposed within said housing and defining a bore therethrough with a pair of ports extending outwardly from said bore to communicate with a reservoir formed within said housing, said piston member being movably disposed within said cylinder and cooperating with said cylinder and a first check valve to substantially define a variable volume chamber, said piston member defining a central passage extending from the reservoir to the variable volume chamber, said piston member carrying a second check valve within the central passage to separate one portion of the central passage which forms a part of the variable volume chamber from another portion of the central passage communicating with the reservoir, said piston member defining an aperture extending outwardly from the one portion of the central passage to alternate communication with the pair of ports in response to movement of said piston member within said cylinder bore from a rest position to an extended position, said piston member disposing the aperture in communication with one of the ports in the rest position, said piston member moving the aperture to communicate with the other port before the extended position is reached in order to gradually reduce the fluid pressure generated in the variable volume chamber to substantially that fluid pressure within the reservoir, and said second check valve opening communication between the reservoir and the central passage when said piston member moves from the extended position toward the rest position to prevent the fluid pressure level within the variable volume chamber decreasing substantially below that fluid pressure level for the reservoir whereby the fluid pressure level within the variable volume chamber remains substantially the same as, or slightly less than, the fluid pressure level within the reservoir when said piston member is moving from the extended position to the rest position.

* * * * *